United States Patent [19]

Swanstrom

[11] 4,044,812

[45] Aug. 30, 1977

[54] REMOTELY OPERATED WINDOW SHUTTERS

[76] Inventor: Paul W. Swanstrom, 505 McNamara Ave., Hastings, Minn. 55033

[21] Appl. No.: 664,161

[22] Filed: Mar. 5, 1976

[51] Int. Cl.[2] ..... E05D 15/26

[52] U.S. Cl. ..... 160/206; 160/118

[58] Field of Search ..... 160/118, 187, 199, 206, 160/207, 213; 49/337, 341, 342, 343, 344, 354

[56] References Cited

U.S. PATENT DOCUMENTS

| | | | |
|---|---|---|---|
| 1,651,453 | 12/1927 | Harrison, Jr. | 160/206 |
| 2,159,861 | 5/1939 | Poteet | 49/342 |
| 2,166,441 | 7/1939 | Jones | 49/342 |
| 2,841,219 | 7/1958 | Helwig | 160/206 |
| 2,860,701 | 11/1958 | Wood et al. | 160/206 |
| 3,610,313 | 10/1971 | Friedrich | 160/206 |

*Primary Examiner*—Peter M. Caun

*Attorney, Agent, or Firm*—Schroeder, Siegfried, et al

[57] ABSTRACT

An articulated window shutter which can be remotely opened to a fully opened position wherein both shutter elements are parallel to the wall of the structure in which the shuttered aperture is located and wherein the shutter operating elements are fully enclosed in the structure wall.

1 Claim, 7 Drawing Figures

REMOTELY OPERATED WINDOW SHUTTERS

This invention relates to shutters, windows and doors. More particularly, it relates to articulated folding shutters which, when opened, lie parallel with the exterior building wall and fully expose the area of the window.

The purpose of this invention is to provide a structure permitting a person within a building to close shutters or storm windows over the building's windows to provide improved insulation characteristics during periods when the outdoor temperature undergoes extreme variations relative to the desired ambient temperature of the building interior.

Because of the rapidly increasing costs of fuel for heating and air conditioning, there is a vast demand today for products which increase the insulating characteristics of buildings. This is particularly true in the residential building industry. The manufacture of a simple and inexpensive shutter structure which will cover a relatively large residential window and which is operable from inside, under all weather conditions, has posed a substantial problem for a considerable period of time. I have solved these problems.

The conventional manner of operating shutters remotely has utilized individually hinged rigid shutter sections which are operated by worm and gear combinations with the worm-gear interface located exterior of the building directly in line with the pivot axis of the shutter assembly. Such structures are shown, for example, in the U.S. Pat. No. to H. K. Sylvester No. 2,112,388.

Although hinged and articulated window structures are shown, for example in U.S. Pat No. 1,792,017 to A. Krausz and U.S. Pat. No. 1,939,781 to J. Kelsey, those structures to the extent that they could be modified to provide an articulated shutter structure, were not contemplated for use with a remotely operated opening and closing structure. Prior art for opening and closing structures such as shown in the Sylvester patent and similar patents are not usable for remotely operating previous articulated structures. It is a general object of my invention to provide an articulated shutter constructed and arranged to completely cover a window in the closed position and to fully expose the window in an opened position wherein both shutter elements lie flat against the exterior building wall, none of which is possible in either of the two aforementioned patents.

A more specific object is to provide a remotely operated articulated shutter wherein the mechanism for operating the shutter is constructed and arranged so that it may be located with the operating parts located within the wall of the building for protection from the elements, and located in the middle of the shutter to distribute the torque evenly throughout the entire panel.

A further object is to provide a shutter which provides resistance to operation by a person outside of the building to provide additional security to the building.

These and other objects and advantages of my invention will more fully appear from the following description, made in connection with the accompanying drawings, wherein like reference characters refer to the same or similar parts throughout the several views, and in which.

Figure 1:
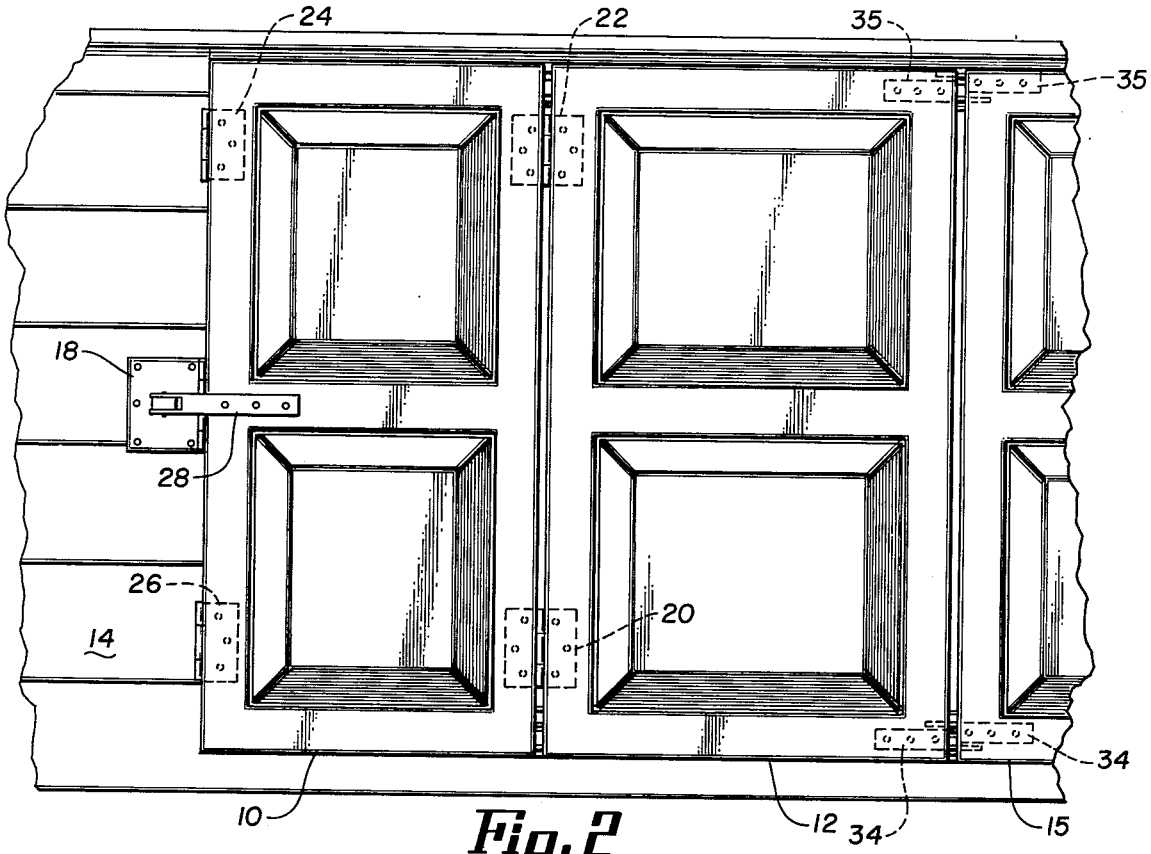
FIG. 1 is a front view of the shutters in the closed position.

FIG. 1 shows the articulated shutter which consists of a first shutter panel 10 and a second shutter panel 12 in the fully extended position mounted on an exterior wall 14 of a building to cover a window. Shown at the right-hand portion of FIG. 1 is a portion of a second panel 15 of a second articulated shutter section covering an additional window or portion of a window, said second shutter being hinged at its right-hand end in a manner analogous to that shown for the shutter assembly comprising panels 10 and 12. In the shutter assembly according to my present invention, it is comtemplated that windows can be covered by a single articulated shutter assembly or by a double articulated shutter assembly without departing from the spirit of my invention.

FIG. 1 also shows a protective cover plate 18 which protects the moving parts of the shutter actuation mechanism from the elements as well as protecting them from tampering and hiding them from view to provide a more aesthetic appearance to the exterior of the building with the shutters in the closed position.

Shutter panels 10 and 12 are hinged together by conventional hinge assemblies 20 and 22 which are located on the side of the shutter assembly toward the window when the shutter is in the closed position. The entire articulated shutter assembly is suspended from the shutter jamb 25 by hinges 24 and 26 which are also mounted on the window-facing side of the shutter assembly in the closed position. The shutter jamb 25 is mounted on the exterior face of the building and extendsfrom the building a distance slightly greater than the thickness of panels 10 and 12 to enable the folding of panel 10 behind panel 12 in the opened position illustrated in FIG. 4.

Figure 2:
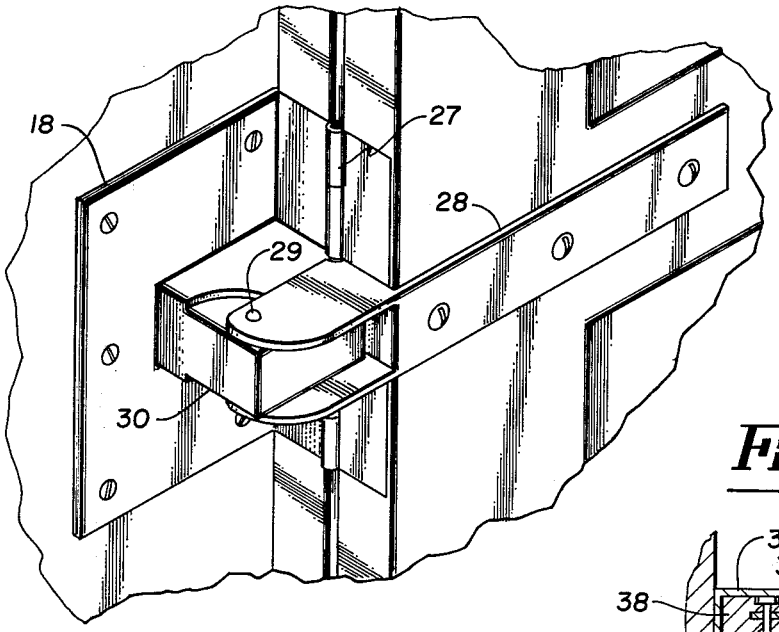
FIG. 2 is a perspective view of the exterior portion of the shutter operating mechanism.

A panel extender 28 is attached to first panel 10 and has a portion which extends beyond the axis of rotation defined by hinges 24, 26 and by an additional hinge 27 which is located in the vicinity of the dooractuation mechanism as shown in FIGS. 1 and 2. The extended protion of door-extender 28 forms a clevis which is pinned using a pin 29 to a connecting link 30 which passes through cover plate 18 to the shutter actuation mechanism.

Figure 7:
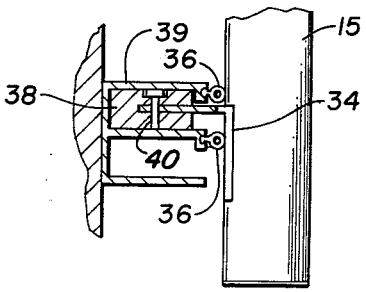
FIG. 7 is a detailed cross-sectional view of the guide assembly used to support the distal end of the articulated shutter assembly in its guide track.
Figure 3:
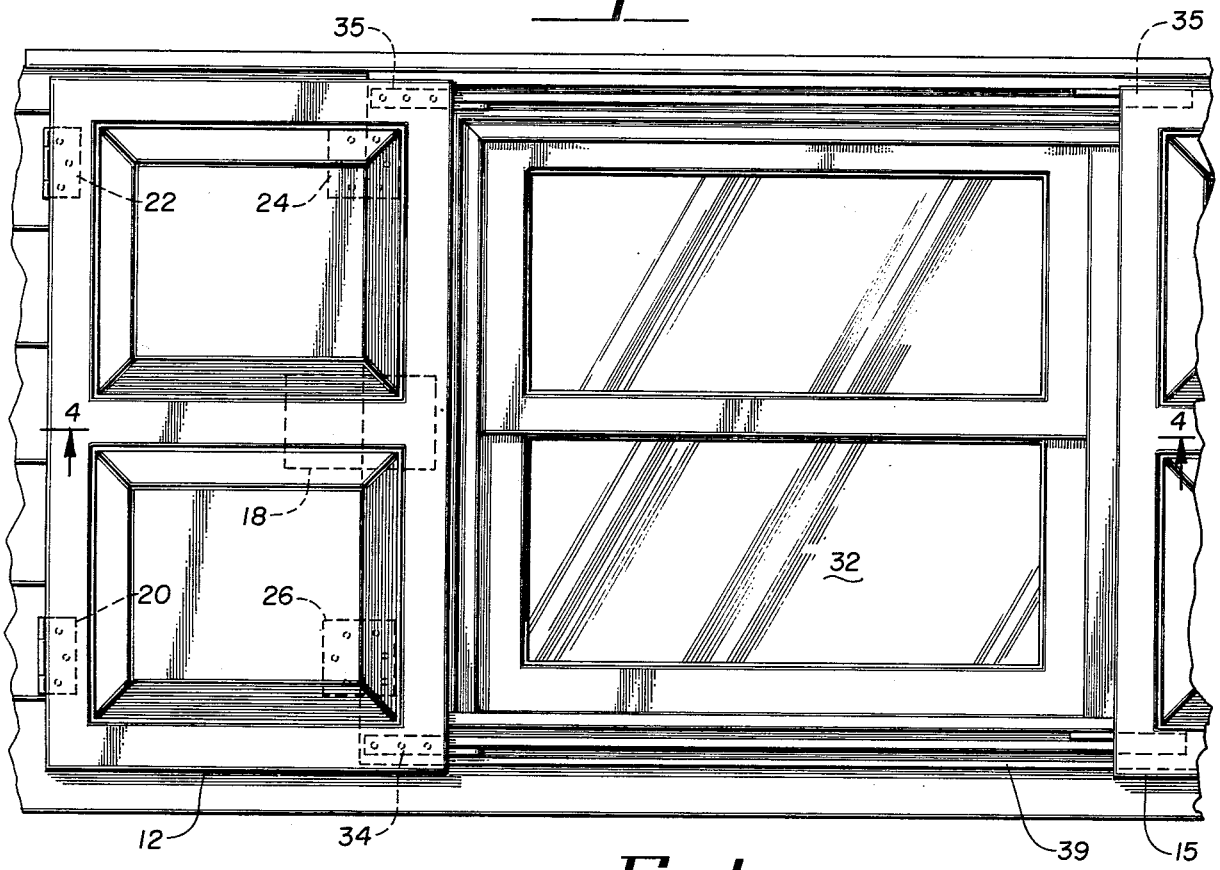
FIG. 3 is a front view of the shutter system in the fully opened position.
Figure 4:
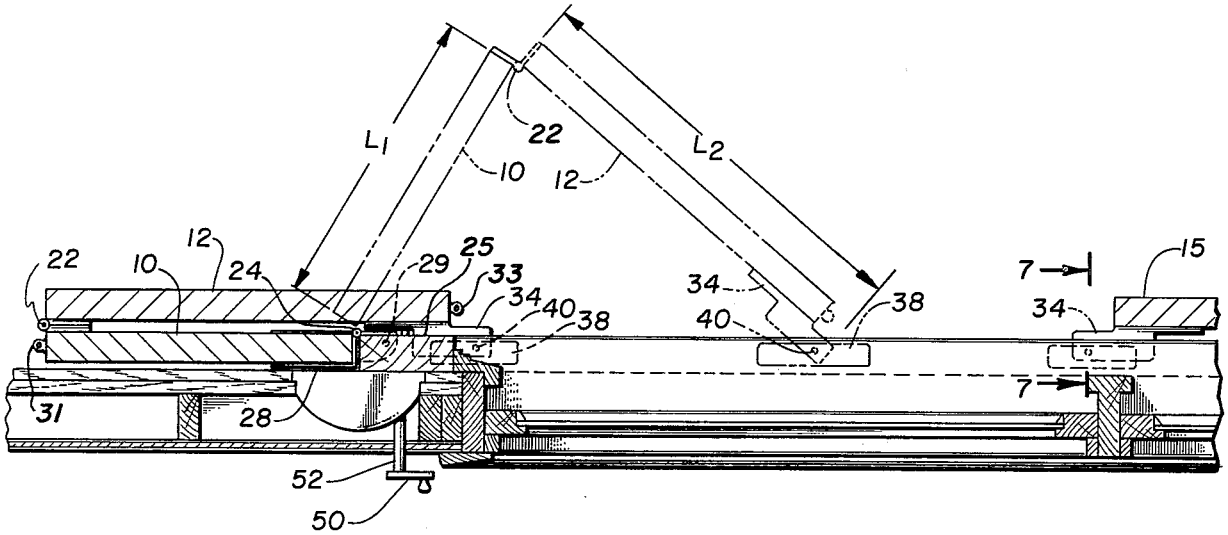
FIG. 4 is a cross-sectional bottom view along section line 4 in FIG. 3 showing the shutter in the fully opened position and also showing the shutter, in phantom outline in the partially closed position.

FIG. 3 is a front view of the articulated shutter in the fully opened position wherein the entirety of window 32 is exposed. Guide assemblies 34 and 35 are attached to the lower and upper interior surfaces, respectively, of the right-hand vertical edge of panel 12 to support and guide the articulated shutter assembly as it is opened and closed. The guide assembly and track are shown in a cross-sectional view in FIG. 7. As shown in FIG. 4, the track is parallel to the building wall for its entire length and projects from the building exterior by an amount equivalent to the projection of shutter jamb 25. The track is protected and concealed behind shutters 10 and 12 when closed to assure that the track is protected from snow and ice when the shutters are closed during a snowstorm.

Figure 6:
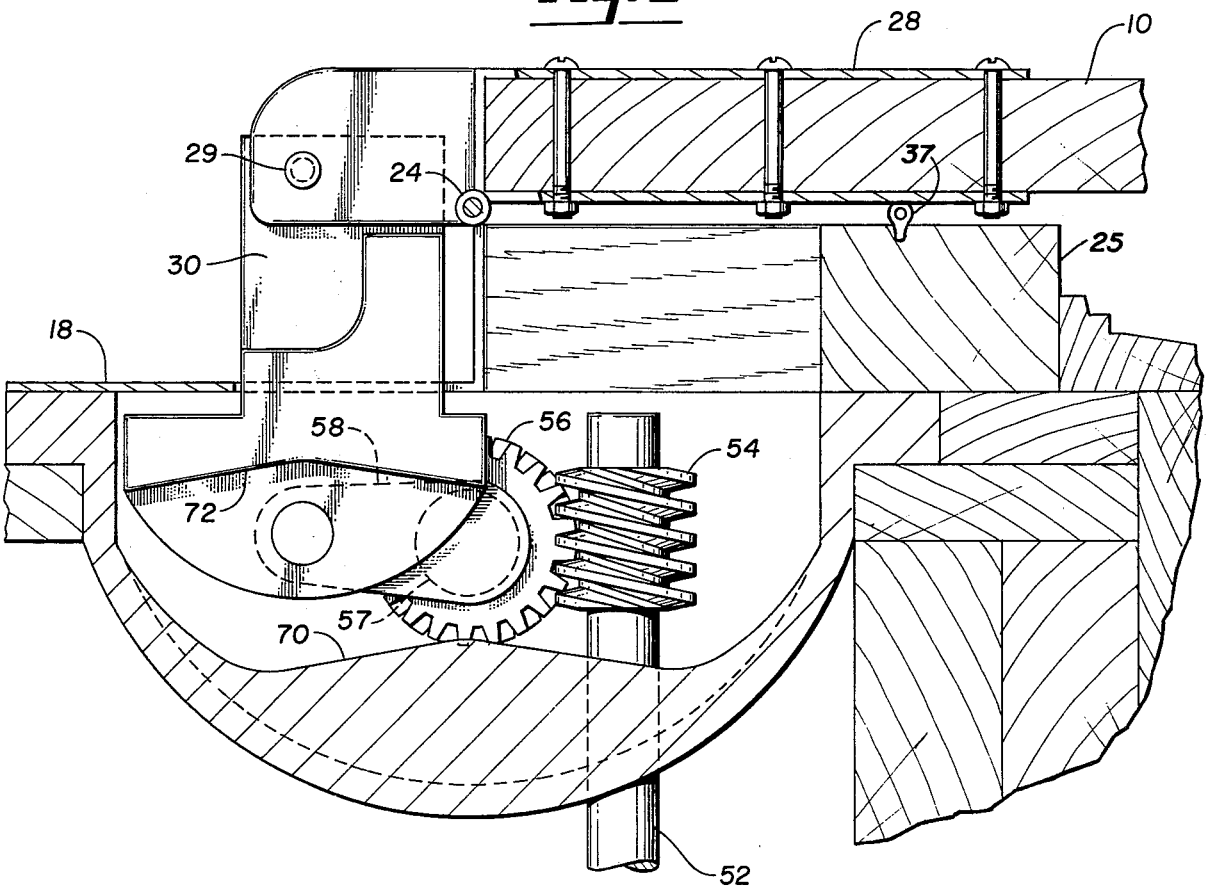
FIG. 6 is a cross-sectional bottom view of the shutter operating mechanism.

Each of the guide assemblies 34 and 35 have a projecting portion which is pinned to a slide member 38 which is movable along a track 39 as the shutter assembly is opened and closed. The pinned connection 40 between the guide bracket 34 and the slide 38 permits rotation of panel 12 about the axis defined by pin 40. Horizontal weather stripping 36 may be attached directly to track 39. The remaining vertical weatherstrips 37, 33 and 31, complete the perimeter and median seal and are shown in FIGS. 4 and 6.

Guide assemblies 34 and 35 further function to hold the leading edge of door 12 away from track 39 and weather stripping 36 as the shutters are being closed. When the shutters are nearly closed, the operation of guides 34 and 35 forces panels 10 and 12 into intimate contact with weather strip 36 to assure an airtight seal.

As shown in FIG. 4 for example, the shutters are moved from the fully opened position shown in the figure to the partially closed position shown in phantom lines of the figure by rotating panel 10 about a vertical axis defined by hinges 24, 26 and 27 by exerting a force on the clevis of panel extender 28 tending to urge the clevis toward the interior of the building and rotate panel 10 in a clockwise direction as shown in FIG. 4. As panel 10 is rotated in a clockwise direction, the right-hand end of panel 12 begins to move along track 39 to the right as panel 12 begins to rotate about pin 40 as slide 38 moves toward the right. A continuation of the rotation of panel 10 in the clockwise direction continues until panels 10 and 12 completely cover window 32 and are parallel to wall 14.

I have discovered that in order to permit the articulated shutter assembly to be readily driven from a closed to an open position utilizing a remotely driven actuator mechanism that the widths of shutter panels 10 and 12 must be in a particular relationship to each other. In particular, I have discovered that the width of panel 12 from hinge 20 to pin 40, must exceed the width of panel 10 by a considerable margin so that an adequate force continues to drive slide 38 in track 39 throughout the entirety of the opening cycle. When the respective effective widths of panels 10 and 12, $L_1$ and $L_2$, respectively are nearly equal, it is virtually impossible to develop enough rotational force on panel 10 to continue to exert sufficient force on slide 38 to overcome frictional forces and continue the opening of the window. In practice it appears that a ratio between $L_2$ and $L_1$ must exceed 1.15 in order to achieve satisfactory a remote operation of the remotely actuated articulated shutter assembly.

Figure 5:
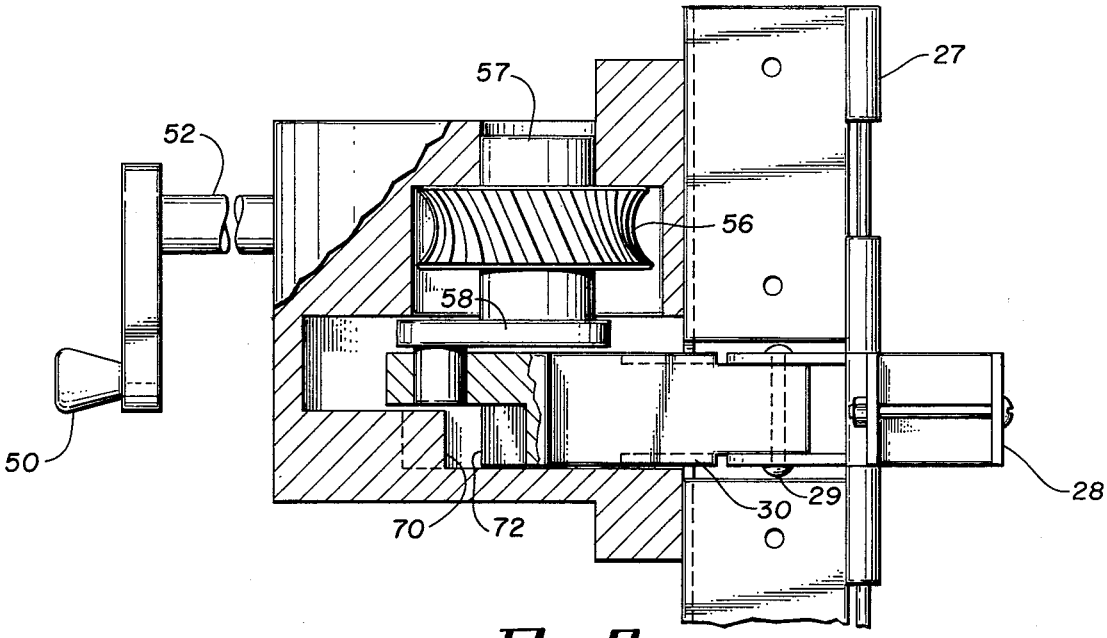
FIG. 5 is a side cross-sectional view of the shutter operating mechanism.

The structure of the actuator mechanism for my assembly is shown in detail in FIGS. 5 and 6. A crank 50 is used to rotate a shaft 52 to which a worm 54 is attached. Worm 54 is in turn engaged with a worm gear 56 which rotates about a vertical axis 57. A drive arm 58 rotates with gear 56 about axis 57 and is pivotally connected to link 30 which projects through plate 18 and is pinned with pin 29 to the clevis of panel extender 28. As can be seen in FIG. 6, rotation of shaft 52 in a clockwise in turn rotates gear 56 and drive arm 58 about its axis 57 in a counterclockwise direction and results in a force on link 30 tending to draw it further into wall 14 and exerts a force on panel 10 through the clevis of panel extender 28 tending to rotate the panel in a counterclockwise direction about the axis defined by the hinge pins of hinges 24, 26 and 27.

I have also discovered that an additional structure is needed to restrict rotational movement of link 30 during a critical portion of the opening and closing cycles of the articulated shutter assembly. When shutter 10 is perpendicular to wall 14, drive arm 58 is rotated 90° counterclockwise from the position shown in FIG. 6 to a resultant position wherein the axis of the pivotal connection between drive arm 58 and link 30, the axis of rotation 57 of gear 56 and the axis of rotation of panel 10 about the hinge axes 24, 26 and 27 are collinear. When this condition occurs, further rotation of the shaft 52 in a clockwise direction, for example, may result in rotation of door panel 10 about its axis in either a clockwise or counterclockwise direction.

In order to avoid this undesirable anomaly in the operation of the shutter actuator, it is necessary to limit the angular rotation of link 30 about an axis normal to said wall during the period when door 10 is substantially perpendicular to wall 14. In my invention this is accomplished by use of a cam surface 70 contained in the housing for the remote actuating mechanism which interfaces with a cooperating cam surface 72 which is formed on link 30. Cam surfaces 70 and 72 come into contact with each other only when panel 10 is substantially perpendicular to wall 14 and serves to prevent substantial angular displacement of the link 30 from the normal. During the opening and closing cycle when the angle of panel 10 passes through the perpendicular, the cooperative action of cam surfaces 70 and 72 acts to prevent any substantial angular displacement of the link from taking place. After the shutter has passed through the perpendicular position, the stabilization of link 30, utilizing cam surfaces 70 and 72, is not necessary and the panel will continue to open as before.

When the shutter assembly is in the closed position, the mechanism actuator assembly is not visible and the connecting link 30 completely covers the aperture in plate 18. Thus, the actuating mechanism is protected from tampering and is not exposed to dirt, moisture and ice since it is protected by plate 18 and located within the wall 14.

Utilization of my articulated shutter assembly obviates the necessity for separate mechanical locking mechanisms because of the mechanical advantage created by the use of the worm gear arrangement. It is not possible for a person outside of the house to actuate the structure by attempting to manually open the shutter. It is, of course, possible to give added security by providing a pinned locking device passing through guide brackets 34 and the mating guide bracket of the adjacent articulated shutter assembly when two articulated assemblies are used to positively hold the assembly in the closed position. When only one shutter assembly is used the bracket 34 may be pinned directly to a clevis located on the jamb to positively prevent unauthorized movement of the shutter.

Other modifications and alterations may be made to structures shown herein without departing from the spirit or scope of my invention which is tended to be limited only by the scope of the appended claims.

I claim:

1. A remotely operated folding shutter system for covering or uncovering an aperture in a building wall, comprising, in combination:

a first rectangular shutter panel pivotally mounted about a vertical axis with a first vertical edge adjacent to an edge of the aperture to be covered;

a second rectangular shutter panel having a width slightly greater than the width of said first shutter panel pivotally connected along one vertical edge to said first panel with one vertical edge of said second shutter panel aligned adjacent to the second vertical edge of said first shutter panel;

track means mounted above and below said aperture in said building wall;

slide means mounted for slidable movement along said track along a straight path substantially parallel to said building wall;

guide means connected at one end to the other vertical edge of said second rectangular shutter panel and pivotally connected at the other end to said slide means;

a worm mounted on a rotatable shaft which projects through said wall;

a worm gear mounted on a frame for rotation about a substantially vertical axis, said worm gear being engaged with said worm to rotate about said vertical axis when said worm is rotated about its shaft axis;

a drive arm having one end fixed to said worm gear for rotation of said drive arm when said worm gear is rotated about said vertical axis;

a connecting link pivotally connected at one end to the free end of said drive arm and pivotally connected at its other end to an extension of said shutter;

a first cam block attached to said link, said cam block having a cam surface;

a mating cam block attached to said frame with cam surface cooperative with the cam surface of said first cam block, said cam surface operative when said shutter is perpendicular to said wall to limit the angular rotation of said link to within approximately 20 degrees of perpendicular, thereby to prevent a relative reversal of the direction of rotation of said shutter relative to rotation of said rotatable shaft.

* * * * *

UNITED STATES PATENT AND TRADEMARK OFFICE

CERTIFICATE OF CORRECTION

PATENT NO. : 4,044,812

DATED : August 30, 1977

INVENTOR(S) : Paul W. Swanstrom

It is certified that error appears in the above-identified patent and that said Letters Patent are hereby corrected as shown below:

Column 1, line 31: after "Pat." delete --No.--

Column 2, line 44: change "extendsfrom" to --extends from--

Column 2, line 51: change "dooractuation" to --door-actuation--

Column 2, line 53: change "protion" to --portion--

Column 3, line 63: after "clockwise" insert --direction--

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*